United States Patent [19]

Glazunov et al.

[11] 4,154,286

[45] May 15, 1979

[54] INSTALLATION FOR DIE-CASTING OF METAL BLANKS

[76] Inventors: Sergei G. Glazunov, Leninsky prospekt, 41, kv. 62; Alexei M. Khromov, Ukhtomskaya ulitsa, 36a, kv. 19; Vasily V. Merkulov, 3 Dorozhny proezd, 10, korpus 2, kv. 27; Igor B. Krjuchkov, Begovaya ulitsa, 22, korpus 16, kv. 68; Nikolai E. Klimov, Aviamotornaya ulitsa, 4, korpus 4, kv. 253; Dmitry A. Filippov, Saratovskaya ulitsa, 8/10, kv. 138, all of Moscow, U.S.S.R.

[21] Appl. No.: 864,757

[22] Filed: Dec. 27, 1977

[51] Int. Cl.[2] ..... B22D 17/10; B22D 17/14; B22D 39/00; B22D 43/00

[52] U.S. Cl. ..... 164/158; 164/52; 164/61; 164/133; 164/252; 164/256; 164/258; 164/314; 164/335

[58] Field of Search ..... 164/52, 252, 256, 258, 164/61, 133, 158, 314, 335

[56] References Cited

U.S. PATENT DOCUMENTS 3,201,835 8/1965 Cooper et al. ..... 164/52

*Primary Examiner*—Othell M. Simpson
*Assistant Examiner*—J. Reed Batten, Jr.
*Attorney, Agent, or Firm*—Lackenbach, Lilling & Siegel

[57] ABSTRACT

The installation comprises a pressure tight casing with vacuum melting and casting chambers communicating with each other via a pressing chamber. The vacuum melting chamber accommodates an electrode holder arranged above a melting pot. Located under the melting pot is a pouring device with funnels, one of which is inserted into a hole in the shell of the pressing chamber. The vacuum melting chamber incorporates an appliance for cleaning the used funnels and a mechanism for moving the funnels. The pressing chamber communicates with the pressmould. One half of the pressmold is secured on an immovable vertical plate and the other half is mounted on a movable vertical plate. The movable vertical plate travels over horizontal guides.

5 Claims, 6 Drawing Figures

INSTALLATION FOR DIE-CASTING OF METAL BLANKS

FIELD OF THE INVENTION

The present invention relates to foundry production and, more particularly, it relates to installations for die-casting of metal blanks.

Best results will be yielded by the present invention in casting precision blanks from high-melting and high-reactive metals and alloys based on, for example, titanium or zirconium.

DESCRIPTION OF THE PRIOR ART

Known in the previous art is an installation for die-casting of metal blanks (see, for example, English Pat. No. 914508).

This installation comprises a pressure tight casing mounted on a frame and two vertical immovable plates interconnected by horizontal guide columns which accommodate a movable plate provided with a reciprocating drive.

An electrode holder mounted in the melting portion of the installation is intended to hold a consumable electrode and to supply electric current to it. A melting pot is arranged under the consumable electrode and is secured on a horizontal axle which is linked kinematically with a reversible rotation drive for turning said melting pot around the horizontal axis in order to pour out molten metal and to return the pot to the initial position. The melting pot has a chute for pouring out molten metal and a funnel installed in a hole located in the side wall of the pressing chamber shell.

The shell of the pressing chamber is built into the vertical stationary plate adjoining the melting portion of the installation. The pressing chamber receives a pressure piston of the hydraulic cylinder for forcing molten metal from the pressing chamber into the pressmould. The pressing chamber is in communication with the pressmould, one half of which is provided with a gate bushing and is rigidly secured to the stationary plate adjoining the melting portion of the installation.

The other half of the pressmould is fixed to the movable plate enclosed in the pressure tight casing of the installation.

However, in the installations with this type of casing, such parts of said installation as the movable plate and its kinematic linkage with the reciprocating drive work in a vacuum. This hampers servicing a number of the installation mechanisms and offers additional difficulties in creating a vacuum in the internal space of the installation.

To counter this disadvantage, there appeared installations wherein the casing of the casting chamber is separated from the melting chamber and is made air-tight.

Nevertheless, such installations also have a disadvantage residing in an imperfect design of the pouring device which interferes in some respects with normal functioning of the installation. For example, each time after the molten metal has been fed into the pressing chamber through the funnel, the inside walls of said funnel become covered with a crust of hardened metal. This crust prevents the next portion of molten metal from being delivered into the pressing chamber. After two or three pourings, the outlet hole of the funnel becomes completely obstructed by the crust of solidified metal and the installation ceases to function.

In order to replace or clean the funnel, the installation has to be cleared of its vacuum, the clogged funnel has to be removed and replaced by a clean one, the installation has to be sealed again and a new vacuum has to be created. All these operations take a great amount of time. The down-time of the installation caused by replacement and cleaning of funnels leads to losses of working time of the attending personnel and to the need for additional equipment which, taken together, makes the blank-casting process considerably more expensive.

In spite of the aforesaid disadvantages, installations for die-casting of blanks have become increasingly popular in recent years. This can be attributed to the development of machine-building and a high demand for die-cast blanks, so that the provision of a continuous die-casting installation proves to be a pressing necessity.

SUMMARY OF THE INVENTION

The main object of the present invention is to provide an installation for die-casting of metal blanks which is more efficient than the existing installations of similar application.

Another object of the invention is to increase the reliability of the installation.

Still another object of the invention is to improve the quality of the cast blanks.

These and other objects are accomplished by providing an installation for die-casting of metal blanks comprising a frame supporting two rigidly secured vertical plates interconnected by horizontal guide columns. On the guide columns a movable plate provided with a reciprocating drive is accommodated. Supported on the movable plate is a mould holder. Half of the pressmould is enclosed in the pressure tight casing of the vacuum casting chamber and secured on one of the rigidly secured plates and the other half of the mould is secured on the movable plate. The pressure tight casing of the vacuum melting chamber is secured to the stationary plate which accommodates a built-in shell of the pressing chamber. The shell has a hole for inserting the funnel. The pressing chamber receives a pressure piston of a hydraulic cylinder for feeding molten metal into the pressmould through its gate bushing. An electrode holder and a melting pot are accommodated in the vacuum melting chamber. The melting pot is capable of turning around its horizontal axis. The installation according to the invention, comprises a pouring device consisting of at least two funnels and a mechanism intended to move said funnels in vertical and horizontal directions for inserting them alternately into the filler hole located in the pressing chamber shell.

The provision of the pouring device with additional funnels and a mechanism which moves them to the required position allows the process of casting metal blanks to be conducted without depressurizing the installation for a long time.

This, in turn, increases the output of the installation and dispenses with the manual labour required for replacing the funnels.

It is expedient that the mechanism for moving the funnels of the pouring device be made in the form of a sector supporting said spaced funnels at a certain pitch and that said sector should be secured in such a way that it rests on a vertical shaft connected with a longitudinal motion drive and on a sleeve mounted on said shaft and provided with a lever for turning the sector in a horizontal direction.

Such a mechanism for moving the funnels of the pouring device is simplest from the viewpoint of design and sufficiently reliable.

It is expedient that the lever for turning the sector should be provided with a built-in retainer in the form of a spring-loaded bar passing through a hole in the wall of the sleeve which fits around a case rigidly connected with the casing of the vacuum melting chamber and provided with sockets to receive the free end of the bar.

The retainer makes it possible to secure the funnels in the required position.

The installation should be provided with at least one appliance for cleaning the funnels such an appliance comprises a hydraulic cylinder, with a rod fastened to the casing of the vacuum melting chamber, a scraper secured to the rod and a bar carrying a grip and secured with the aid of a ball joint permitting longitudinal displacement.

Such an arrangement will allow the funnels to be cleaned alternately of the crust of solidified metal without disturbing the vacuum in the melting chamber, while simultaneously feeding molten metal from the melting pot into the pressing chamber through another clean funnel. As a result, each funnel can be alternately cleaned and used repeatedly during continuous functioning of the installation.

BRIEF DESCRIPTION OF THE INVENTION

Now the invention will be described in detail by way of example with reference to the accompanying drawings in which.

DETAILED DESCRIPTION OF THE INVENTION

Figure 1:
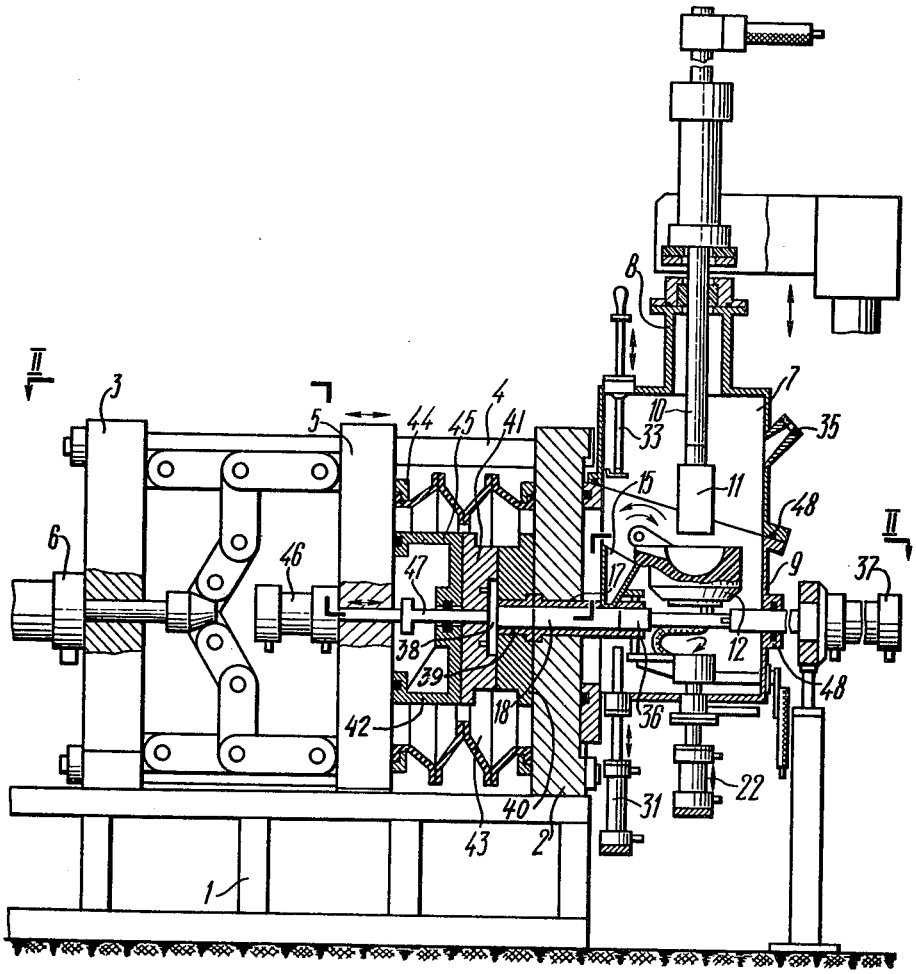
FIG. 1 is a side view of the installation partially broken away and with a cross-sectional view through a vertical plane of portions of the melting and casting chambers.
Figure 2:
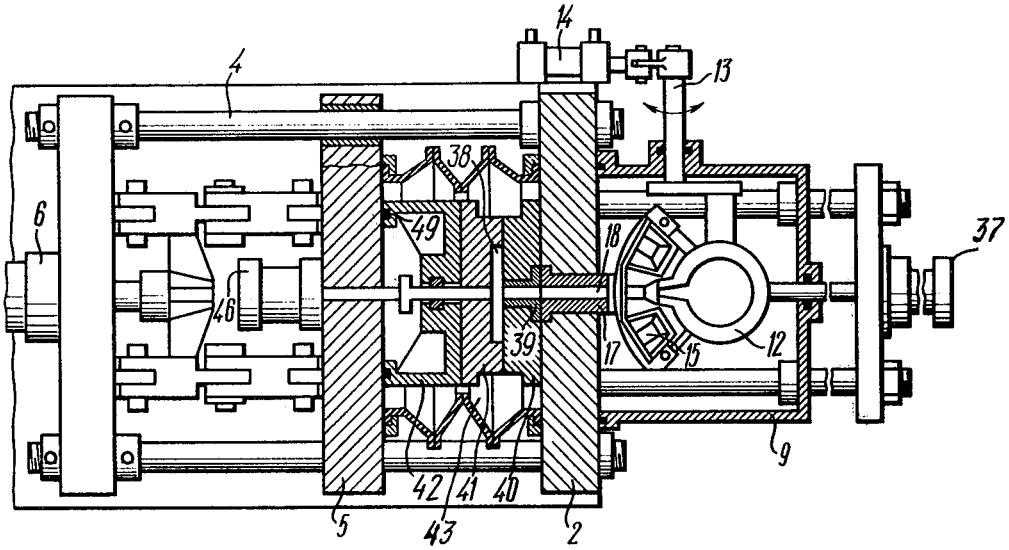
FIG. 2 is a top view of the same installation with a cross-sectional view taken along the line II—II in FIG. 1.

The installation for die-casting of metal blanks consists of a frame 1 (FIG. 1) and two vertical plates 2 and 3 secured rigidly on said frame and interconnected by horizontal guide columns 4 (FIG. 2). A movable plate 5 with a reciprocating drive 6 is mounted on the guide columns 4.

Mounted on the stationary vertical plate 2 is a pressure tight casing of a vacuum melting chamber 7 (FIG. 1) which is divided in a lateral direction into an upper part 8 (cover) and a lower part 9.

The vacuum melting chamber 7 accommodates an electrode holder 10 intended to hold a consumable electrode 11 and to supply electrical power to it from a source of electric power (not shown in the drawing).

Installed under the consumable electrode 11 is a melting pot 12 secured on a horizontal axle 13 (FIG. 2) which is kinematically linked with a drive 14 for turning the melting pot 12 relative to the horizontal axis.

Figure 4:
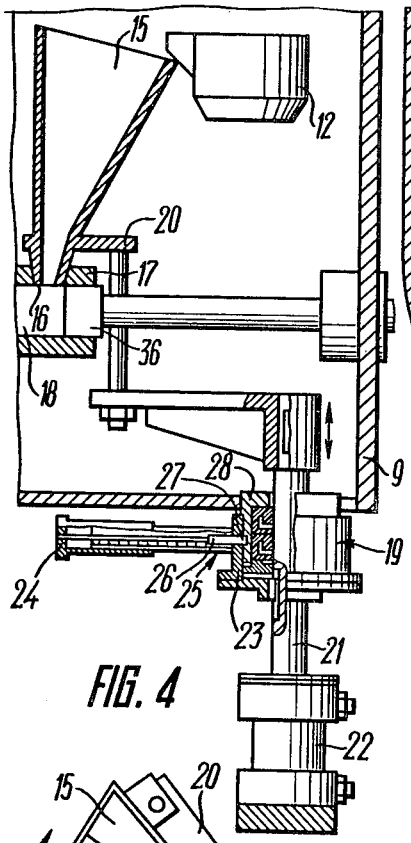
FIG. 4 is an enlarged side, elevational view of the pouring device, with a mechanism for moving the funnels, partially broken away and with cross-sectional views of portions in a vertical plane.
Figure 3:
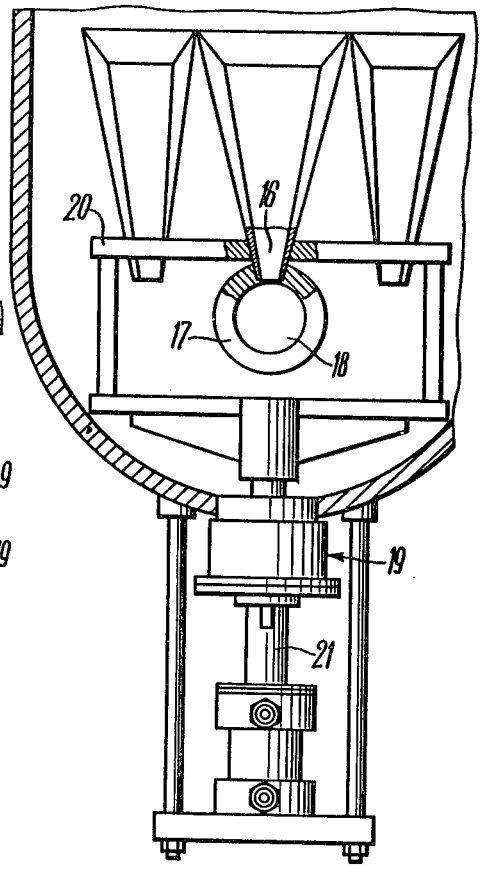
FIG. 3 is an enlarged, elevational view of the pouring device with a mechanism for moving the funnels, viewed from the melting pot.
Figure 5:
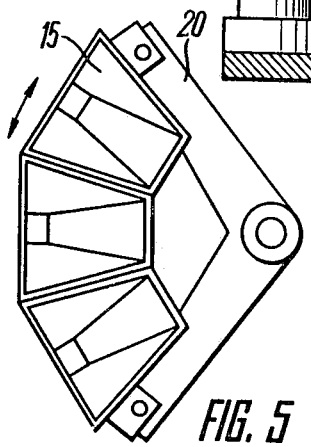
FIG. 5 is a top view of the funnels secured to the sector.

At the side of the discharge chute of the melting pot 12 is a funnel 15 (FIGS. 3 and 4) of a pouring device, said funnel being inserted into a hole 16 in the shell 17 of a pressing chamber 18 (FIGS. 1 and 2). The pouring device, according to the invention, should have at least two funnels 15 (FIG. 5) and a mechanism 19 (FIGS. 3 and 4) for moving said funnels in horizontal and vertical directions with a view to inserting them alternately into the filler hole 16 provided in the shell 17 of the pressing chamber 18.

This mechanism comprises a sector 20 (FIG. 5) for mounting funnels 15 at a certain pitch, said sector being secured on a vertical shaft 21 (FIG. 4) which is kinematically linked with a longitudinal motion drive 22. The shaft 21 supports a sleeve 23 with a lever 24 for turning the sector 20 in a horizontal direction. After the sector 20 has been turned through the desired angle, it can be fixed in place by a retainer 25 in the form of a spring-loaded bar 26 passing through the sleeve 23 and entering sockets 27 made in a stationary case 28 which is secured on the lower part 9 of the casing of the vacuum melting chamber 7 (FIG. 1).

Figure 6:
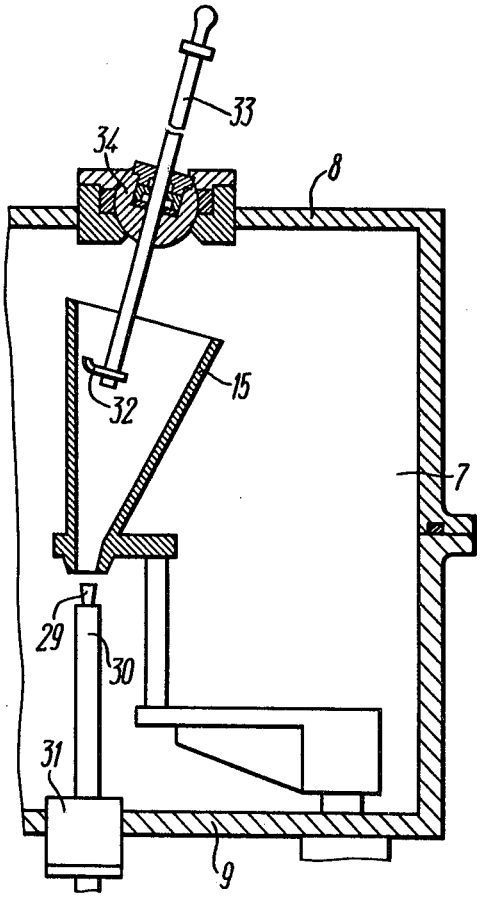
FIG. 6 is a side, cross-sectional view of the appliance for cleaning the funnels of the pouring device.

The installation comprises at least one appliance for cleaning the funnels 15 (FIG. 6) which consists of a scraper 29 (FIG. 6) mounted on the rod 30 of a hydraulic cylinder 31 and a grip 32 installed on a bar 33 and connected by means of a ball joint 34 which permits longitudinal displacement of the bar 33 with the grip 32. The scraper and grip are secured, respectively, on the lower and upper parts 9 and 8 of the vacuum melting chamber 7 (FIG. 1) and inserted into it.

An inspection port 35 (FIG. 1) serves for watching the work of the cleaning appliance.

The filling funnels 15 (FIG. 5) are arranged on the sector 20 at such a distance from one another as to ensure coaxial position of the funnel 15 being cleaned between the scraper 29 (FIG. 6) and the grip 32 while the clean funnel 15 is in the filler hole 16 (FIG. 3) of the shell 17 of the pressing chamber 18.

The shell 17 (FIG. 1) of the pressing chamber 18 is built into the immovable plate 2.

At the side of the vacuum melting chamber 7, the shell 17 receives the pressure piston 36 of the hydraulic cylinder 37 for forced feed of molten metal into the pressmould 38 (FIG. 2) through the gate bushing 39.

The half 40 of the pressmould 38 with the gate bushing 39 is secured on the immovable plate 2 (FIG. 1). The other mould half 41 (FIG. 2) is fastened in a mould holder 42 on the movable plate 5.

The pressmould 38 is enclosed into the pressuretight casing of a vacuum casting chamber 43 (FIG. 1), said casing consisting of two movable parts 44 and 45. Secured to the vertical movable plate 5, on the outside relative to the part 44 of the casing of the vacuum casting chamber 43, is a hydraulic cylinder 46 whose rod interacts with a pusher 47 entering the pressmould 38 (FIG. 2).

Pressuretightness of the upper and lower parts 8 and 9 (FIG. 1) of the casing of the vacuum melting chamber 7 and of the parts 44 and 45 of the vacuum casting chamber is ensured by special vacuum seals 48 (FIG. 1) and 49 (FIG. 2).

The installation functions as follows.

First, a vacuum is created in the melting and casting vacuum chambers 7 and 43 (FIG. 1) with the aid of vacuum pumps (not shown in the drawing). Then the drive 6 is turned on and moves the plate 5 towards the plate 2 until the halves 40 (FIG. 2) and 41 of the pressmould 38 are tightly closed.

One of the funnels 15 of the pouring device is set in position for feeding metal into the pressing chamber 18. Then electric current is fed to the electrode holder 10 (FIG. 1) for melting the consumable electrode 11 by the heat liberated by the electric arc between said electrode 11 and the slag which covers the lining of the melting pot 12. The process of melting of the consumable electrode 11 continues until the amount of molten metal accumulated in the melting pot 12 becomes sufficient for filling the pressmould 38 (FIG. 2). Then the consumable electrode 11 (FIG. 1) is lifted out of the melting pot 12.

The melting pot 12 with metal is turned with the aid of the drive 14 (FIG. 2) and axle 13 around its horizontal axis and the molten metal is drained through the discharge chute of the melting pot 12 (FIG. 1) into the funnel 15 and, from there, into the pressing chamber 18. Then the hydraulic cylinder 37 with the pressure piston 36 is set in operation and this piston delivers a portion of molten metal into the pressmould 38 (FIG. 2). The blank is held in the pressmould 38 long enough for shaping the blank and cooling it to the preset temperature.

Unloading of the metal blank from the pressmould 38 is carried out by turning on the drive 6 and withdrawing the plate 5 from the plate 2.

While the pressmould 38 is opening, the hydraulic cylinder 46 is set in motion for pushing the metal blank from the movable half 41 of the pressmould 38. Then the pressmould 38 is cleaned of splashed metal.

The cleaned halves 40 and 41 of the pressmould 38 are closed by the drive 6 which propels the movable plate 5 towards the immovable plate 2. Simultaneously, the drive 22 of the mechanism 19 in the vacuum melting chamber 7 (FIG. 1) shifts upward the sector 20 (FIG. 4) with the filling funnels 15, after which the sector 20 is turned horizontally by the lever 24 through a preset angle and the used funnel 15 is withdrawn sidewise from the pressing chamber 18 (FIG. 3) to the point of location of the scraper 29 (FIG. 6) and grip 32 for cleaning the funnel 15 of metal crust. Inasmuch as the funnels 15 are set at a certain distance from one another, the funnel withdrawn for cleaning is replaced by the next clean funnel 15 above the hole 16 (FIGS. 3 and 4) in the shell 17 of the pressing chamber 18.

The clean funnel 15 is lowered by the drive 22 into the filler hole 16 of the shell 17 of the pressing chamber 18.

This completes the working cycle of the installation. The following cycles can be performed without destroying the vacuum so that the installation, according to the invention, as confirmed by operational tests, can work for a long time, and ensure a high quality of the cast blanks and a higher efficiency than the known installations of the same application.

We claim:

1. An installation for die-casting of metal blanks comprising: a frame; first and second immovable vertical plates rigidly secured on said frame; horizontal guide columns secured to said vertical immovable plates; a movable vertical plate installed on said horizontal guide columns for movement between said vertical immovable plates; a reciprocating drive kinematically linked with said movable plate; a pressure-tight casing defining a vacuum melting chamber, being mounted on one side of said second immovable plate, and separating the vacuum melting chamber from a vacuum casting chamber positioned on an opposite side of said second immovable plate; a mold holder secured to said movable plate on a side facing said vacuum casting chamber; a pressure mold defining said vacuum casting chamber and having a first half secured on said mold holder and a second half fastened to said second immovable plate; a hollow shell defining a pressing chamber built into said second immovable plate and provided with a filler hole on a side facing said vacuum melting chamber, said pressing chamber interconnecting said vacuum melting chamber and said vacuum casting chamber; a gate bushing secured to said second half of said press mold and putting said vacuum casting chamber of said press mold in communication with said pressing chamber; a pressure piston of a hydraulic cylinder inserted into said shell of the pressing chamber for forced feeding of metal into said vacuum casting chamber of said press mold; an electrode holder located in said vacuum melting chamber; a melting pot secured under said electrode holder and being turnable relative to a horizontal axis in said vacuum melting chamber; a drive for turning said melting pot; a pouring device comprising at least two funnels located beneath said melting pot and inserted alternately into the filler hole in said shell of the pressing chamber; a mechanism for moving said funnels in vertical and horizontal directions during their alternate insertion into the filler hole of said shell of said pressing chamber.

2. An installation according to claim 1, wherein said mechanism for moving the funnels of said pouring device comprises a sector which supports spaced funnels at a certain pitch; a vertical shaft on which said sector rests; a drive for longitudinal motion of said vertical shaft; and a sleeve secured on said vertical shaft and provided with a lever for turning the sector in a horizontal direction.

3. An installation according to claim 2 wherein said lever for turning said sector has a built-in retainer in the form of a spring-loaded bar passing through a hole in a wall of said sleeve which fits around a case rigidly connected with said casing of the vacuum melting chamber and provided with sockets to receive the free end of said bar.

4. An installation according to claim 1 comprising at least one means for cleaning said funnels including a hydraulic cylinder with a rod supporting a scraper, and a bar carrying a grip and secured with the aid of a ball joint permitting longitudinal displacement, the cylinder and the bar being secured to said casing of the vacuum melting chamber.

5. An installation according to claim 4, wherein said vacuum melting chamber comprises lower and upper parts, and said hydraulic cylinder carrying said rod and scraper being secured to said lower part of said vacuum melting chamber, and said bar carrying said grip being secured to said upper part of said vacuum melting chamber.

* * * * *